United States Patent [19]

Weathers et al.

[11] 4,402,406

[45] Sep. 6, 1983

[54] MULTIPLE SIZED CHAIR BASE

[75] Inventors: Douglas W. Weathers; Robert B. Gardner, both of Shelby, N.C.

[73] Assignee: Container Corporation of America, Chicago, Ill.

[21] Appl. No.: 321,464

[22] Filed: Nov. 16, 1981

[51] Int. Cl.[3] ..... B65D 5/06; B65D 85/00

[52] U.S. Cl. ..... 206/326; 206/486; 206/590; 206/562

[58] Field of Search ..... 206/486, 590, 591, 562, 206/563, 326, 327, 63.5; 229/29 F

[56] References Cited

U.S. PATENT DOCUMENTS

| | | | |
|---|---|---|---|
| 819,678 | 5/1906 | Simmons | 206/63.5 |
| 2,979,248 | 4/1961 | Washington | 206/591 |
| 3,338,501 | 8/1967 | Clay | 206/326 |
| 3,682,597 | 8/1972 | Husch | 206/45.19 X |
| 3,750,872 | 8/1973 | Bobb | 206/326 |
| 4,170,297 | 10/1979 | Johnson | 206/326 |
| 4,184,592 | 1/1980 | Howard, Jr. | 206/327 |

*Primary Examiner*—William T. Dixson, Jr.
*Assistant Examiner*—Brenda J. Ehrhardt
*Attorney, Agent, or Firm*—Richard W. Carpenter; Davis Chin

[57] ABSTRACT

A universal supporting base formed of paperboard for holding, within an outer box or wrapper, one of many different size multi-legged articles of furniture.

3 Claims, 7 Drawing Figures

MULTIPLE SIZED CHAIR BASE

BACKGROUND OF THE INVENTION

1. Field of the Invention

This invention relates generally to furniture packages, and more particularly to a paperboard base for use in an outer container or wrapping which base is adapted to support one of many different size multi-legged articles of furniture such as chairs.

2. Description of the Prior Art:

A prior art search in the United States Patent and Trademark Office directed to the subject matter of this application disclosed the following U.S. Pat. Nos. 862,771; 1,072,526; 1,255,553; 1,350,970; 1,858,856; 2,004,536, 2,212,310; 2,426,783; 2,510,680; 2,809,775; 2,838,071; 2,881,502; 2,885,165; 2,939,624; 3,130,833; 3,369,728; 3,516,627; 3,533,547; 3,682,597; 3,797,653; 4,033,653; 4,069,992; 4,109,876; 4,117,929; 4,143,843; 4,170,297; 4,185,739; 4,220,308.

None of the prior art patents found in the search disclosed a universal paperboard base for use in a furniture package which base included inner and outer members with the outer member having a plurality of openings designed to accommodate different chair leg arrangements.

SUMMARY OF THE INVENTION

This invention relates to furniture packages, and more particularly to a chair package which includes a paperboard base adapted to receive the legs of the chair or similar article and which in turn is positioned within an outer container or wrapper such as a shrink film wrapper or strapping.

It is an object of the invention to provide a multi-sized base for use with chairs having different sized legs so as to minimize the number of packages a chair manufacturer is required to have in inventory to accommodate his various sizes and shapes of chairs.

A more specfic object of the invention is the provision of a base of the type described which includes an outer folder having a plurality of openings strategically arranged to accommodate chairs of varying arrangements.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
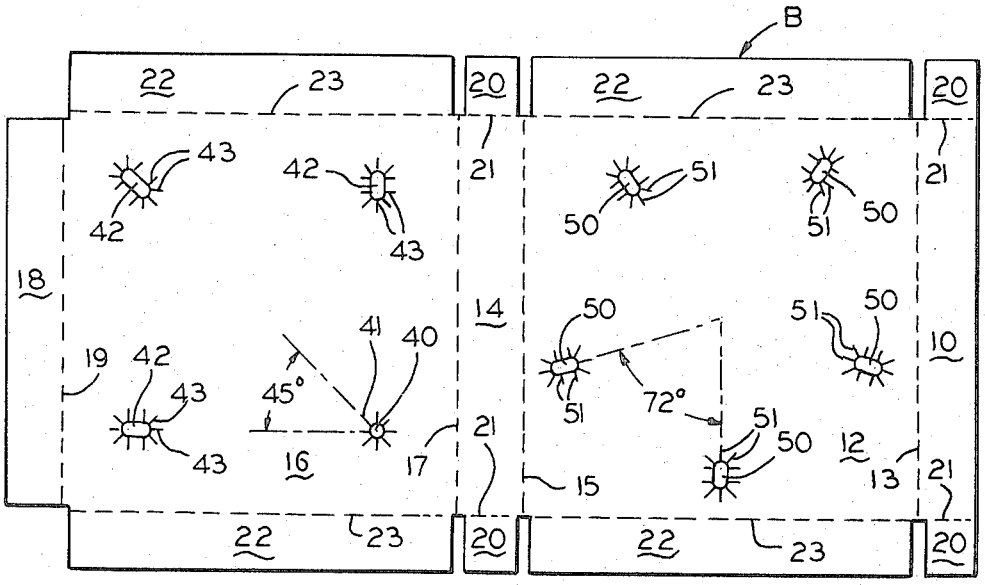
FIG. 1 is a plan view of a blank of foldable sheet material, such as paperboard, from which the outer folder of the base illustrated in the other views may be formed.
Figure 2:
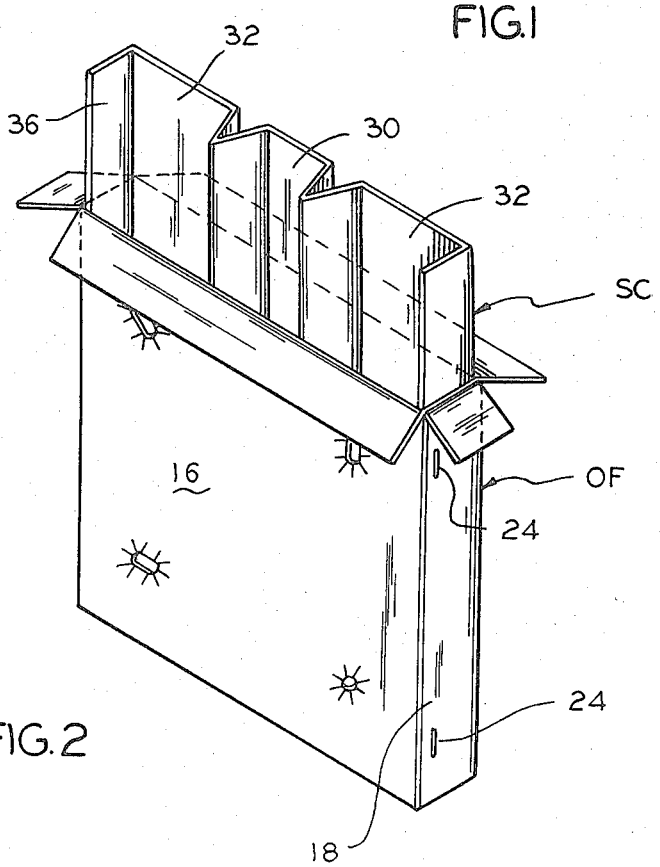
FIG. 2 is a perspective view of the outer and inner portions of the base for packaging furniture which embodies features of the invention.
Figure 3:
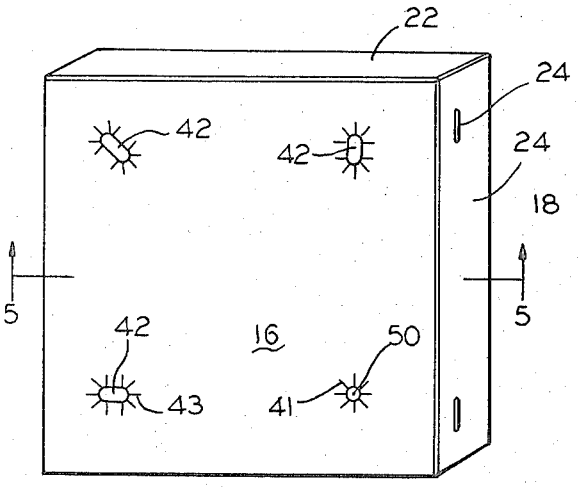
FIGS. 3 and 4 are perspective views of opposite sides of the base embodying features of the invention.
Figure 4:
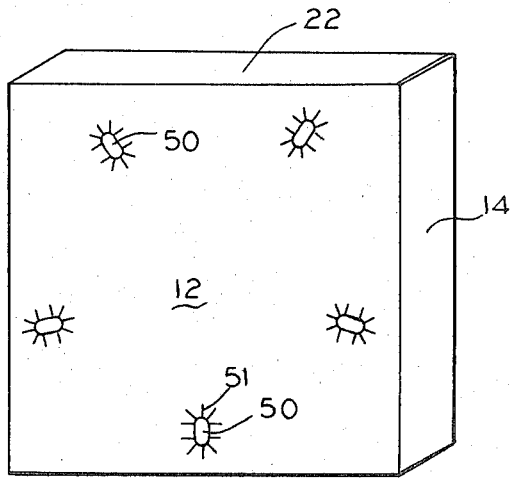
Figure 5:
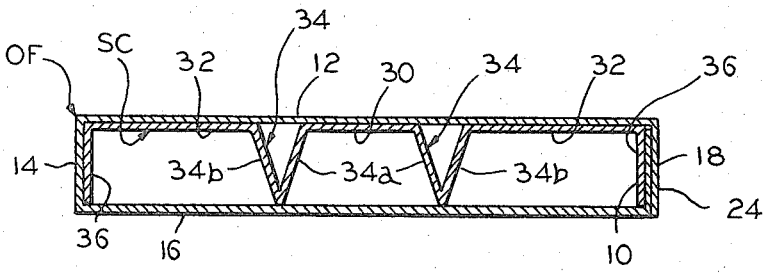
FIG. 5 is a transverse vertical section taken on line 5—5 of FIG. 3.
Figure 6:
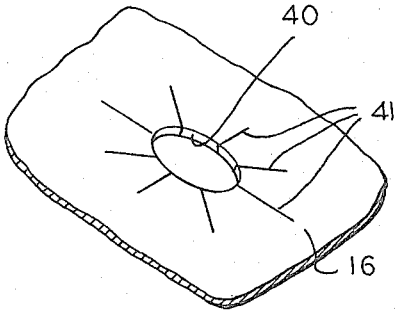
FIGS. 6 and 7 are enlarged perspective views of portions of the structure illustrated in FIG. 3.
Figure 7:
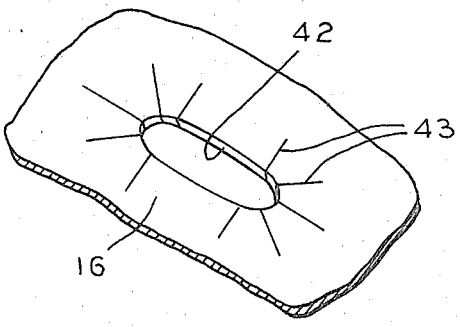

Referring now to the drawings for a better understanding of the invention, and particularly to FIGS. 1 and 2, it will be seen that the novel base for packaging furniture illustrated in FIG. 2 includes an outer folder OF, which may be formed from the unitary blank B of foldable sheet material such as paperboard illustrated in FIG. 1, and an inner core or support member, indicated generally at SC.

The body portion of outer folder OF, as best seen in FIG. 1, includes a first minor side wall 10, a first major side wall 12, a second minor side wall 14, a second major side wall 16, and an attaching flap 18 which are foldably joined to each other along parallel fold lines 13, 15, 17, and 19, respectively. The panels are joined to each other, as best seen in FIG. 2 with attaching flap 18 secured to first minor side wall panel 10 by staples 24 or in any other desired manner such as by gluing. Thus, a tubular structure is formed open at the ends. The ends of the structure may be closed by opposed pairs of inner and outer closure flaps 20 and 22 which are foldably joined to opposite ends of minor and major side wll panels on fold lines 21 and 23, respectively.

In order to have additional support for the article of furniture to be packaged there may be provided within the outer folder of the base, an inner support member or core indicated generally at SC. Support core SC includes a flat elongated center panel 30 and a pair of side panels 32 which are spaced from the center panel by a pair of elongated arches or supporting panels 34 each of which includes a pair of converging panel sections **34*a* and 34*b* which are foldably joined to panel 30 and panels 32, respectively, and to each other. Center and side panels 30 and 32 are positioned in parallel facing engagement with one of the major side wall panels of the outer folder. At the ends of the support core, there are provided a pair of end panels 36 which are foldably joined to the outboard edges of side panels 32** and which are positioned in parallel facing relation with the inner faces of the minor side walls of the outer folder.

The major side wall panels of the outer folder are provided with sunburst-type openings, which will be described in detail later in the specification, for accommodating receipt of the ends of legs of articles of furniture. First major side wall panel 12 has five such openings for accommodating a fivelegged chair or table; whereas, second major side wall 16 has four such openings for accommodating a fourlegged chair or table.

As best seen in FIG. 1, panel 16 includes a first sunburst-type opening which has a round hole or aperture 40 and a plurality of slits 41 extending radially outward therefrom to accommodate chair legs of varying sizes. Additionally, panel 16 includes three other sunburst openings each of which has an oval central hole or opening 42 and a plurality of slits 41 extending radially outward therefrom. Two of these openings are disposed at right angles to the first mentioned opening and the third opening is disposed at a 45° angle thereto. Thus it will be appreciated that, because of the unusual shape and location of the openings, the panel is capable of accepting one of many chairs with different size legs.

Still referring to FIG. 1 it will be seen that first major side wall panel 12 includes five sunburst-type openings each of which has an oval central opening 50 and plurality of slits 51 extending radially outward therefrom. These openings are arranged at angles of approximately 72° from each other and are designed to accept one article of furniture such as a chair or table of many five-legged articles with leg diameters of varying sizes. In forming the base, it is to be understood that the support core is placed in such a way within the outer folder that the center and side panels 30 and 32 are positioned against the major side panel which is not being used to receive the legs of the article of furniture being packaged.

Thus, it will be appreciated that in the single package of the invention there is a base provided which is adapted to accept both four-legged and five-legged articles of furniture wherein the legs are of varying sizes and shapes. This means that a furniture manufacturer need not carry dozen of packages of various shapes and sizes in which to package furniture with slightly different leg arrangements.

What is claimed is:

1. In a universal supporting base, formed of paperboard, for holding, within an outer box or wrapper, one of many different sized multi-legged articles of furniture, said base comprising:

(a) a folder having pairs of opposed major and minor side wall panels foldably joined to each other to form a tubular structure open at the ends;

(b) flap means for closing the ends of said structure;

(c) one of said major panels having formed therein four sunburst-type openings strategically positioned in the form of a square and the other one of said major panel having formed therein five sunburst-type openings arranged in the form of a pentagon to accommodate the receipt of legs of one of several articles of furniture having legs of different sizes;

(d) each of said sunburst-type openings including a center aperture and a plurality of slits in said one major panel extending radially outward from said aperture; and (e) a supporting core positioned within said folder and including a flat elongated center panel, a pair of side panels and a pair of converging panel sections foldably joined between said center panel and said side panels, said center panel and said side panels being positioned in parallel facing engagement with one of said major panels.

2. A base according to claim 1, wherein certain of said sunburst-type openings has a center aperture that is round.

3. A base according to claim 1, wherein certain of said sunburst-type openings has a center aperture that is oval.

* * * * *